US006877618B2

(12) United States Patent
Mason

(10) Patent No.: US 6,877,618 B2
(45) Date of Patent: Apr. 12, 2005

(54) SHELF AND DISPLAY DEVICE

(75) Inventor: Timothy L. Mason, Melville, NY (US)

(73) Assignee: New Dimensions Research Corporation, Melville, NY (US)

( * ) Notice: Subject to any disclaimer, the term of this patent is extended or adjusted under 35 U.S.C. 154(b) by 0 days.

(21) Appl. No.: 10/718,405

(22) Filed: Nov. 20, 2003

(65) Prior Publication Data

US 2004/0211736 A1 Oct. 28, 2004

Related U.S. Application Data

(63) Continuation-in-part of application No. 29/174,678, filed on Jan. 22, 2003, now abandoned, and a continuation-in-part of application No. 29/176,492, filed on Feb. 24, 2003, now Pat. No. Des. 489,556, and a continuation-in-part of application No. 29/177,331, filed on Mar. 7, 2003, now Pat. No. Des. 486,324.

(51) Int. Cl.[7] ..... A47F 1/04
(52) U.S. Cl. ..... 211/59.2
(58) Field of Search ..... 211/59.2, 59.4, 211/74; 312/35, 45, 60, 72

(56) References Cited

U.S. PATENT DOCUMENTS

| | | | | |
|---|---|---|---|---|
| 1,317,534 A | | 9/1919 | Williams | |
| 1,711,329 A | | 4/1929 | Short | |
| 2,649,207 A | | 8/1953 | Shield | |
| 3,019,907 A | | 2/1962 | Belejack | |
| 3,286,846 A | * | 11/1966 | Brandes | 211/59.2 |
| 3,404,927 A | | 10/1968 | Mellion | |
| D223,041 S | | 2/1972 | Kuenster | |
| 3,900,112 A | | 8/1975 | Azzi et al. | |
| 3,923,159 A | * | 12/1975 | Taylor et al. | 211/59.2 |
| 3,977,523 A | | 8/1976 | Cousino | |
| 4,077,522 A | * | 3/1978 | Trubiano | 211/175 |
| 4,287,992 A | * | 9/1981 | Takemori | 211/59.2 |
| D268,068 S | | 3/1983 | Ellenson et al. | |
| 4,662,523 A | * | 5/1987 | Stein et al. | 211/59.2 |
| 4,684,027 A | | 8/1987 | Wright | |
| 4,744,489 A | | 5/1988 | Binder et al. | |
| 5,353,939 A | | 10/1994 | Beeler et al. | |
| D381,546 S | | 7/1997 | Hunt | |
| 5,788,090 A | * | 8/1998 | Kajiwara | 211/59.2 |
| D404,240 S | | 1/1999 | Man | |
| 6,044,989 A | * | 4/2000 | Sosso | 211/189 |
| D428,738 S | | 8/2000 | Brozak, Jr. | |
| 6,290,077 B2 | * | 9/2001 | Sosso | 211/189 |
| 6,637,604 B1 | * | 10/2003 | Jay | 211/59.2 |
| D486,324 S | | 2/2004 | Mason | |
| D489,556 S | | 5/2004 | Mason | |
| D496,193 S | | 9/2004 | Mason | |
| D496,194 S | | 9/2004 | Mason | |
| 2004/0007546 A1 | * | 1/2004 | Stinnet et al. | 211/59.2 |

OTHER PUBLICATIONS

U.S. Appl. No. 29/174,678, filed Jan. 22, 2003.
U.S. Appl. No. 29/190,255, filed Sep. 17, 2003.
U.S. Appl. No. 10/728,483, filed Dec. 5, 2003.

* cited by examiner

*Primary Examiner*—Jennifer E. Novosad
(74) *Attorney, Agent, or Firm*—Collard & Roe, P.C.

(57) ABSTRACT

A display device has at least one shelf for modular merchandise units having a substantially flat base. The shelf has at least two spaced walls defining a channel between the walls. At least one support is disposed in the channel and receives the base of the merchandise unit or units. Each support has a rearward portion elevated at a first angle, a substantially horizontal forward portion, and an intermediate portion elevated at a second angle greater than the first angle and connecting the rearward and forward portions. When placed on the rearward portion of the support, the merchandise unit will descend by gravity to the forward portion of the support for access to the unit in a selected presentation position.

8 Claims, 5 Drawing Sheets

SHELF AND DISPLAY DEVICE

CROSS REFERENCE TO RELATED APPLICATIONS

This application is a Continuation-in-Part (CIP) application of U.S. patent application Ser. No. 29/174,678 filed on Jan. 22, 2003, entitled "Design for a SHELF", now abandoned; U.S. patent application Ser. No. 29/176,492 filed on Feb. 24, 2003, entitled "Design for a SHELF", now U.S. Design Pat. No. D489,556; and U.S. patent application Ser. No. 29/177,331 filed on Mar. 7, 2003, entitled "Design for a DISPLAY UNIT", now U.S. Design Pat. No. D486,324. Priority is claimed under 35 U.S.C §120 based on those applications.

BACKGROUND OF THE INVENTION

1. Field of the Invention

The present invention relates to display devices and more particularly to a shelf for a display device designed to hold modular merchandise units such as packet boxes and to provide a gravity feed for the product so that when a box is removed, the next box will slide down for access by a consumer.

2. The Prior Art

At the present time there are a large variety of known display devices in which articles of merchandise are loaded at one side of the device and move by gravity along a downward course to a forward or dispensing position at the opposite side of the device. See U.S. Pat. No. 4,744,489 to Binder et al. ; U.S. Pat. No. 3,404,927 to Mellion; U.S. Pat. No. 3,900,112 to Azzi et al.; U.S. Pat. No. 1,317,534 to Williams; U.S. Pat. No. 1,711,329 to Short; U.S. Pat. No. 2,649,207 to Shield; U.S. Pat. No. 3,019,907 to Belejack; and U.S. Pat. No. 5,353,939 to Beeler et al.

The Binder et al. has two straight parallel courses and has a nonrefill aspect that stops the product in the upper course from being introduced into the lower course for dispensing until the lower course is fully emptied.

The Mellion patent shows a battery dispenser in which the cylindrical batteries descend in a zig-zag pattern to a dispensing station at the forward-most end of the rack.

Batteries and other objects are often packaged in modular merchandise units such as packet boxes, called "MODS" or "PDQs", which have a substantially flat base. Such modular units when loaded on display devices which use a straight gravity-fed course have several disadvantages. If the angle of the incline is too steep, the modular units can tilt forward and rotate, so that the base of the merchandise unit is no longer in contact with the floor of the course. Such rotation results in the product not being presented correctly at the dispensing end of the display device. For example, the front of the unit intended for display to the customer may be flipped over at the dispensing location so that the wrong side of the package is visible to the consumer.

More typically, displays that use a straight gravity-fed course have a more moderate incline, for example between 17° and 22° or 24° relative to the horizontal. However, with such displays there is often insufficient pressure acting on the last unit loaded in the display that one or more of the units fail to advance to the correct presentation position at the dispensing location of the display.

Some display devices have a relatively flat dispensing location which is fed by a straight inclined ramp. These devices also have the disadvantage that the modular unit frequently gets stuck in the display device. For example, the unit may be prevented from moving forward by the unit ahead of it at the rear end of the dispensing location.

Hence, there is still a need for a shelf for a display device which can accommodate modular merchandise units such as packet boxes so that the units descend by gravity from the loading end of the shelf and be presented at the correct display angle at the dispensing end of the shelf.

SUMMARY OF THE INVENTION

A shelf is provided for a display device for at least one modular merchandise unit having a substantially flat base. The shelf includes at least two spaced-apart walls defining a channel between the walls and at least one support disposed in the channel for receiving the base of the merchandise unit. Each support has a rearward portion elevated at a first angle, a substantially horizontal forward portion, and an intermediate portion connecting the rearward and forward portions elevated at a second angle greater than the first angle. When placed on the rearward portion of the support, the merchandise unit will descend by gravity to the forward portion of the support for access to the unit in a selected presentation position.

In another aspect, a display device is provided for at least one modular merchandise unit having a substantially flat base. The device includes a housing including at least one open face and at least one shelf supported in the housing. The shelf includes at least two spaced walls defining a channel between the walls and a support disposed in the channel for receiving the base of the merchandise unit. Each support has a rearward portion elevated at a first angle, a substantially horizontal forward portion, and an intermediate curved portion connecting the rearward and forward portions elevated at a second angle greater than the first angle so that the merchandise unit when placed on the rearward portion of the support will descend by gravity to the forward portion of the support for access to the unit in a selected presentation position.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
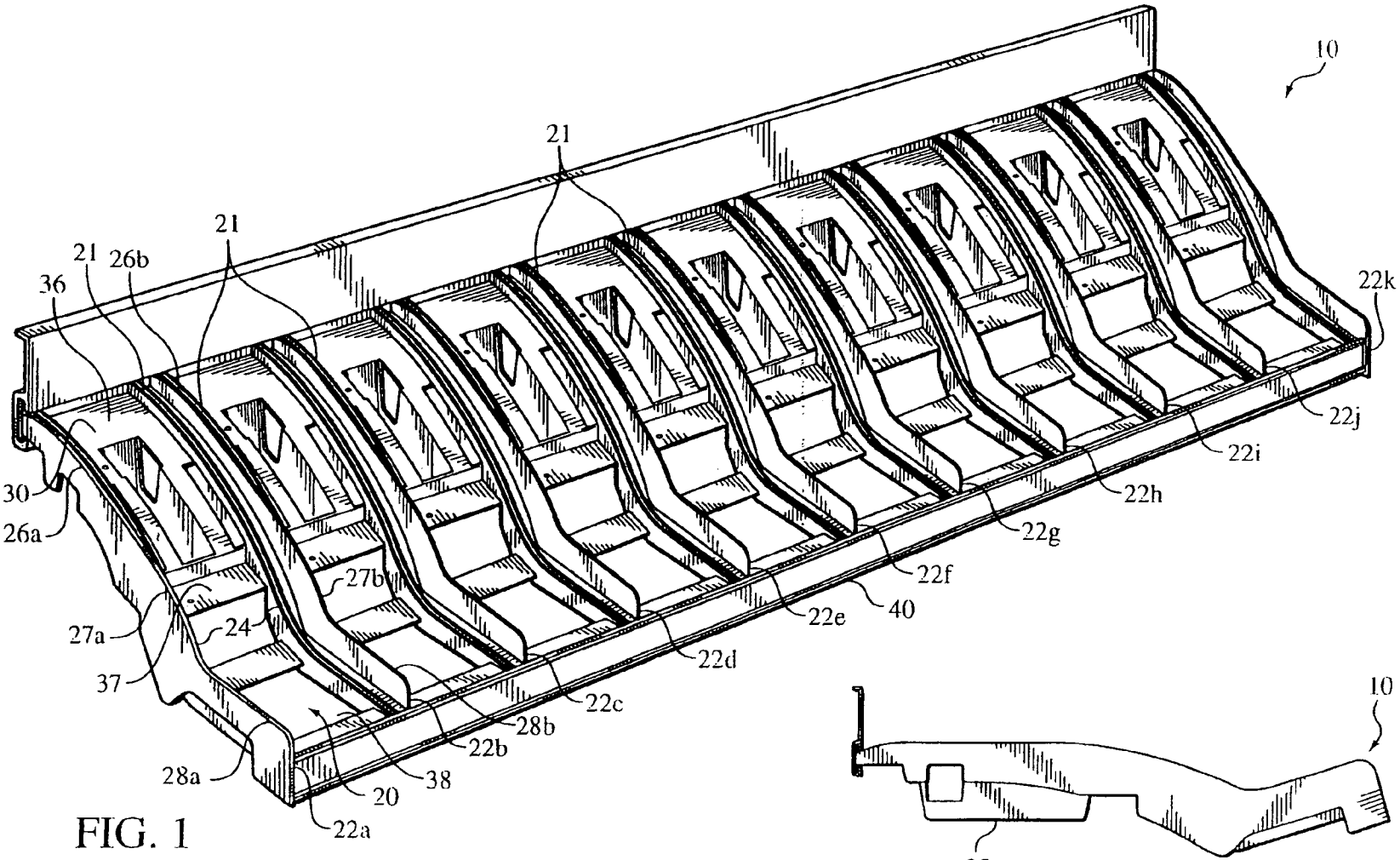
FIG. 1 is a perspective view of an embodiment of a shelf in accordance with the invention.
Figure 2:
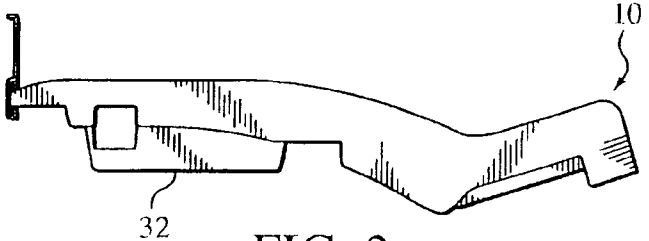
FIG. 2 is a side view of the embodiment of FIG. 1.
Figure 3:
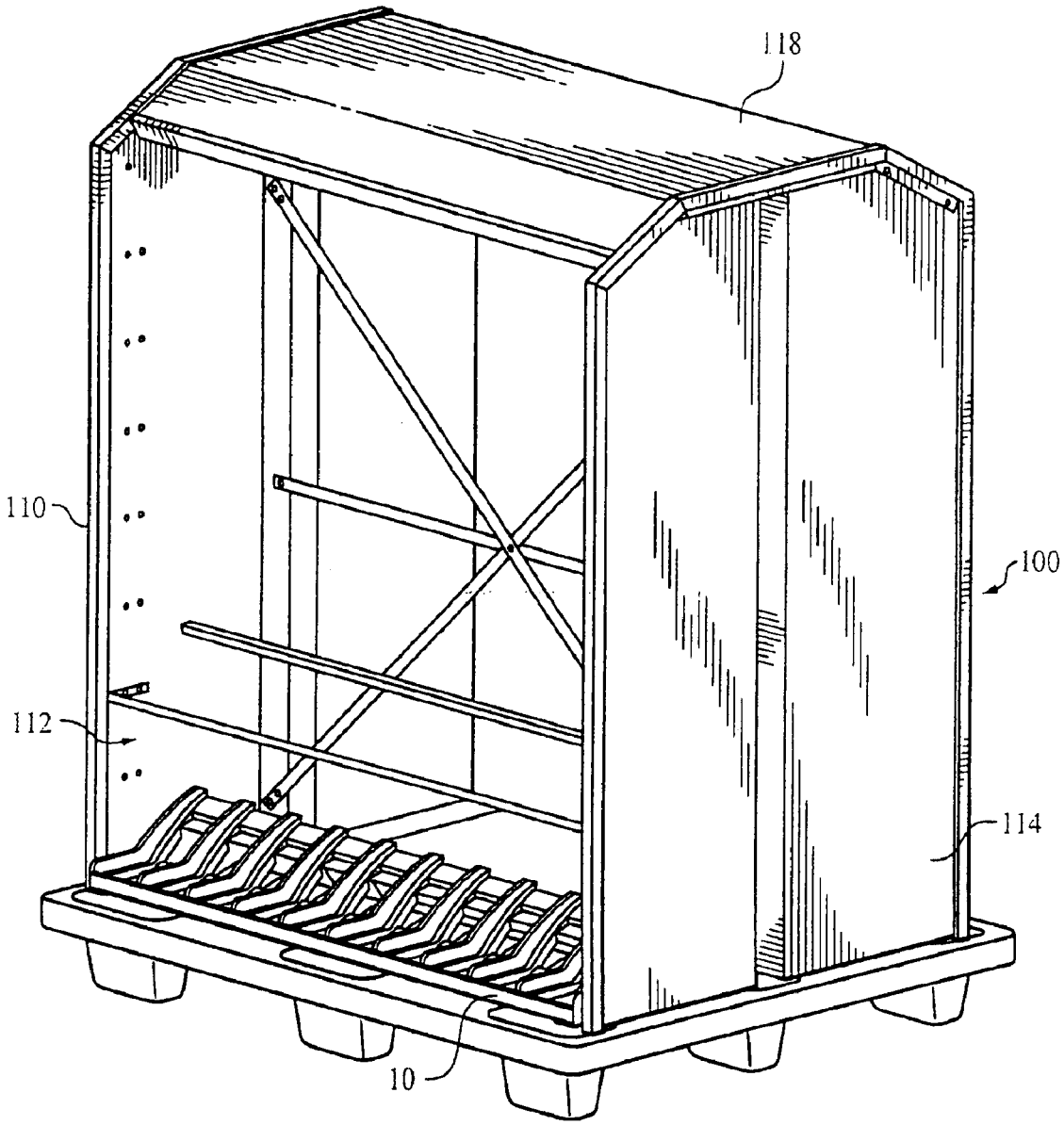
FIG. 3 is a perspective view of an embodiment of a display device incorporating the shelf of FIG. 1 in accordance with the invention.
Figure 4:
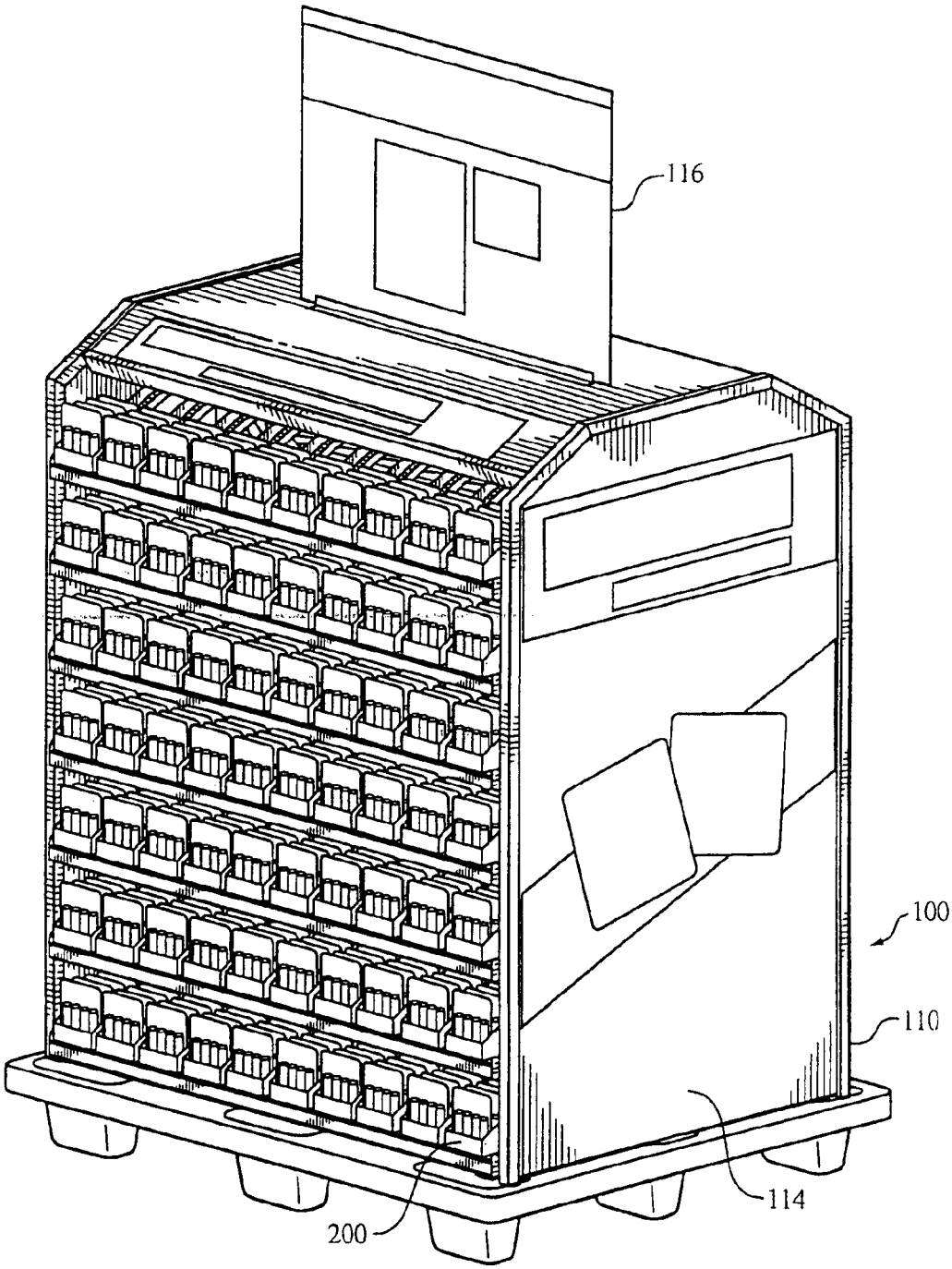
FIG. 4 is a perspective view of the embodiment of FIG. 3 showing a number of shelves filled with product.

Turning now to the drawings, FIGS. 1–2 show a shelf 10 for a display device such as display device 100 shown in FIGS. 3–4. Shelf 10 is designed to hold at least one modular merchandise unit such as battery package carrier 200 shown in FIG. 4. As shown in FIG. 4, each modular merchandise preferably is presented to the consumer in a substantially upright or perpendicular position. As shown in FIGS. 5A–5D modular merchandise unit 200 has a substantially flat base 210 and holds a number of merchandise packages 220, six being shown for each unit in FIGS. 5A–5D.

Shelf 10 has a track 20 formed by two spaced walls 22*a*, 22*b* defining a channel 24 between walls 22*a*, 22*b*. Preferably, shelf 10 has a number of adjacently-spaced walls defining at least two channels. For example, as shown in FIG. 1, shelf 10 may have additional tracks formed by walls 22*b*, 22*c*; 22*c*, 22*d*; 22*d*, 22*e*; 22*e*, 22*f*; 22*f*, 22*g*; 22*g*, 22*h*; 22*h*, 22*i*; 22*i*, 22*j*; 22*j*, 22*k*. In the embodiment shown in FIG. 1, walls 22*a* and 22*k* are outer walls, and walls 22*b*–22*j* are inner walls, and ten channels are defined between adjacent ones of walls 22*a*–22*k*.

A support 30 connects lower portions of each set of wall pairs, such as walls 22*a*, 22*b*. In the embodiment shown in FIG. 1, there are ten track supports connecting lower portions of adjacent ones of the wall pair sets. Support 30 receives and supports base 210 of merchandise unit 200 placed thereon. Preferably, support 30 includes at least two spaced-apart members connected to a portion of a respective wall on opposite sides of the channel for the ends of the base of the modular merchandise unit to ride on. In this way, support 30 may have a large amount of open space between the members which are near the walls. Transverse brackets or cross-members as is shown in FIG. 1 may be used to provide support for the shelf.

The support and preferably also the walls have a rearward portion elevated at a first angle, a substantially horizontal forward portion, and an intermediate portion connecting the rearward and forward portions elevated at a second angle greater than the first angle. For example, as shown in FIG. 1, track 20 has an inclined rearward portion formed by rearward portions 26*a*, 26*b* of walls 22*a*, 22*b*; a substantially horizontal forward portion formed by forward portions 28*a*, 28*b* of walls 22*a*, 22*b*; and an intermediate portion connecting the rearward and forward portions formed by intermediate portions 27*a*, 27*b* of walls 22*a*, 22*b*. Preferably a connector 40 connects the forward portions of outer walls 22*a* and 22*k*.

Support 30 has a rearward portion 36 elevated at a first angle, a substantially horizontal forward portion 38, and an intermediate portion 37 connecting rearward portion 36 and forward portion 38. Intermediate portion 37 is elevated at a second angle greater than the first angle, i.e. greater than the angle of the rearward portion relative to the horizontal. For example, the first angle may be approximately 21° and the second angle may be approximately 41°. Forward portion 38 is substantially horizontal, for example elevated at 2° relative to horizontal. By increasing the incline in the intermediate portion, the shelf is able to accommodate multiple modular units within each channel without the risk of the unit being stalled within the channel from lack of gravitational force. Thus, the modular units feed fully in the channel so that they descend without getting stuck to the dispensing portion of the display. The product thus will descend to the forward portion of support 30 and be presented in a position perpendicular to the consumer. On the underside of support 30 is a retainer 32 shown in FIG. 2 for holding modular merchandise units placed below shelf 10.

As shown in FIG. 1, each wall may have a guide portion 21 extending inwardly toward the channel 24 for engaging side portions of the modular merchandise unit and guiding the unit during descent from the rearward portion of the support to the forward portion of the support.

Preferably, the inclined rearward portions of track 20 and support 30 are inclined at an angle between 155° and 170° relative to the horizontal. In other words, the inclined rearward portions are elevated at an angle with respect to the horizontal between 10° and 25°. The forward portions of track 20 and support 30 may be inclined at an angle between 135° and 145°, i.e. elevated at an angle with respect to the horizontal between 35° and 45°.

As shown in FIGS. 5A–5D, a merchandise unit 200 when placed on rearward portion 36 of support 30 (FIG. 5A) will descend by gravity to forward portion 38 of support 30 (FIG. 5D) to present the product substantially perpendicularly to the consumer preferably without rotation of base 210 of merchandise unit 200 away from contact with support 30.

Figure 5A:
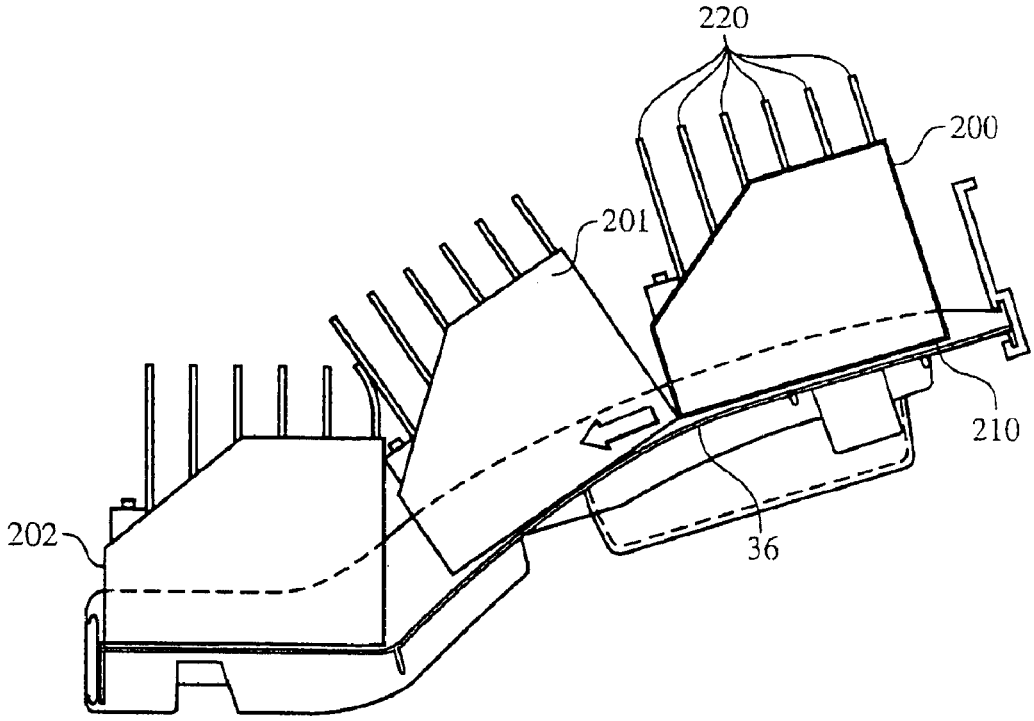
FIGS. 5A–5D are side views of the embodiment of FIG. 1 showing the path of travel of a modular merchandise unit.

FIG. 5A shows merchandise unit 200 loaded on shelf 10 behind two units 201 and 202 ahead of it. Typically, more than three units 200 may be accommodated on a shelf 10 but three are shown for illustration purposes. The units may be loaded from the front or back of the shelf.

Figure 5B:
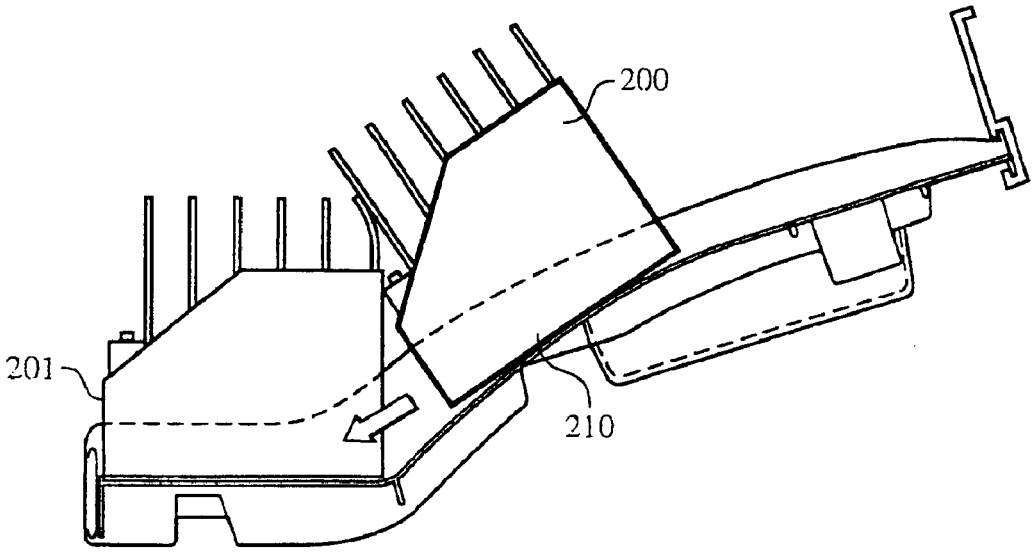

In FIG. 5B, the front unit 202 has been removed and unit 201 slides in place for display. Unit 200 also moves forward from the rearward portion having the smaller elevation to the steeper intermediate portion and rests with its flat surface 210 in contact with shelf 10.

Figure 5C:
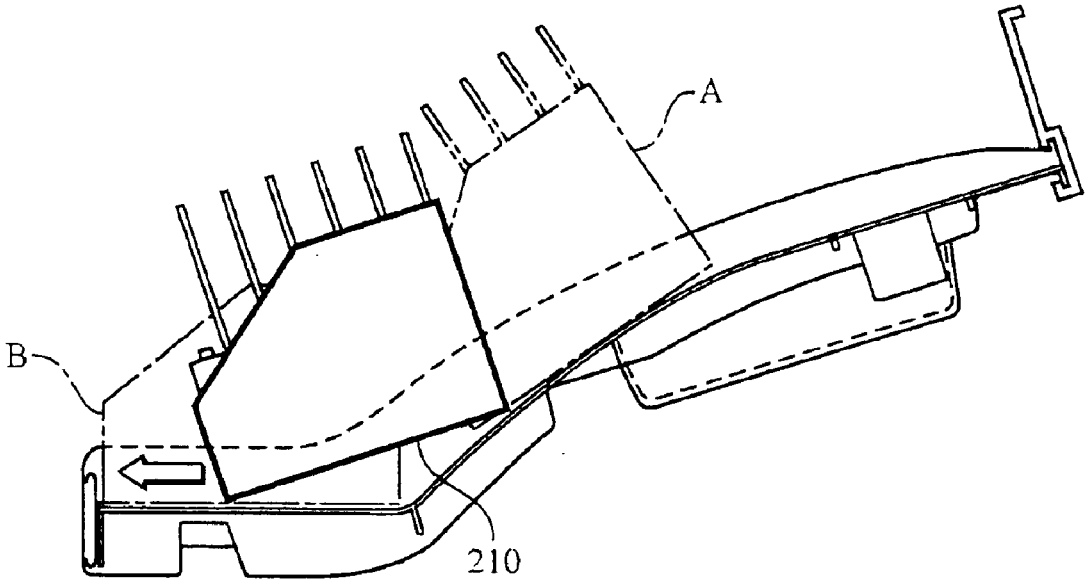

FIG. 5C shows unit 200 moving from position A on the intermediate portion of shelf 110 having the steeper incline to position B at the display or substantially horizontal portion of shelf 10 when unit 201 is removed. Because the product in position A is perched at a particular angle, for example at least 35°, there is enough gravitational force to move it to the dispensing position B when the front unit is removed from the display. As can be seen, unit 200 descends by gravity preferably while maintaining contact with shelf 10 and without rotation so that unit 200 is in the correct presentation position at position B.

Figure 5D:
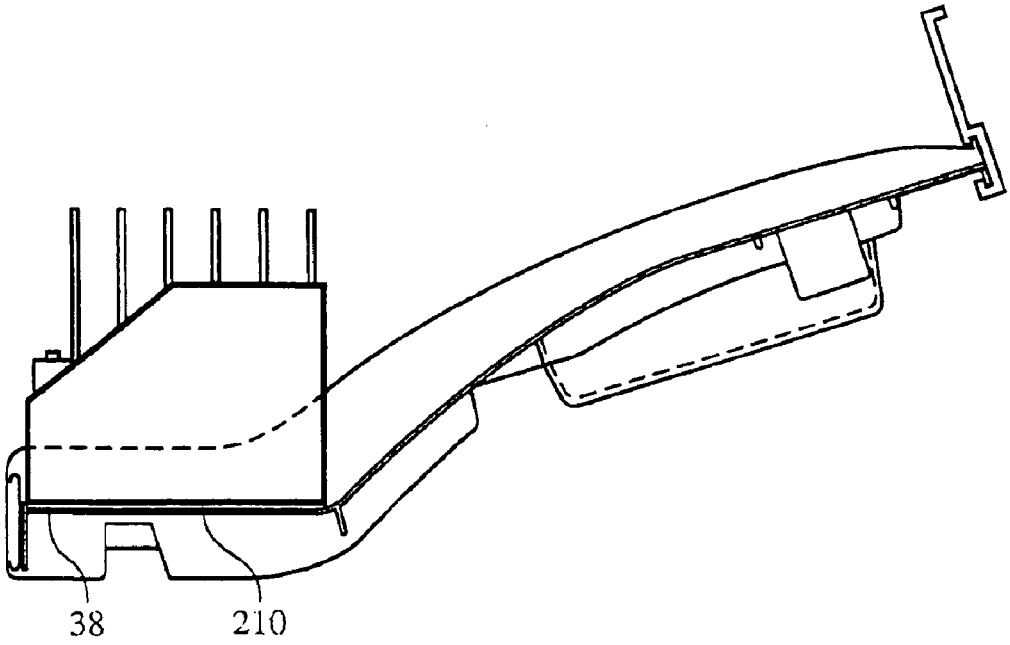

FIG. 5D shows unit 200 fully descended and in correct presentation position.

FIGS. 3 and 4 show a display device 100 for at least one modular merchandise unit 200 having a substantially flat base such as a battery package carrier. Seven vertically-spaced shelves 10 are shown in FIG. 4.

Display device 100 includes a housing 110 of suitable dimensions. For example, housing 110 may be sixty inches tall and have a base forty inches by forty-eight inches. Housing 110 has at least one open face 112 for display of merchandise units 200 on shelves 10. Preferably, housing 110 has two open faces 112 on opposite sides of housing 110.

At least one shelf, and preferably several shelves 10, as previously described and shown in FIGS. 1–2, are supported in housing 110. The retainer, as previously described, on the underside of a shelf support holds the modular merchandise units placed on a vertically-adjacent shelf below that support.

Preferably, housing 110 has sides 114 perpendicular to and connecting open faces 110. Advertising or other graphic material may be placed on sides 114. In addition, a placard 116 or other display sign may be mounted to top 118 of housing 110.

While only a few embodiments of the present invention have been shown and described, it is to be understood that many changes and modifications may be made there unto without departing from the spirit and scope of the invention as defined in the appended claims.

What is claimed is:

1. A gravity-feed shelf for a display device for at least one modular merchandise unit having a substantially flat base, the shelf comprising:

(a) at least two spaced-apart walls defining a channel between said walls; and (b) at least one support comprising at least two spaced-apart members disposed in said channel for the base of the merchandise unit to ride on along a travel path in the channel;

wherein said support has an inclined rearward portion elevated at a first angle between 10° and 25°, a substantially horizontal forward portion, and an inclined intermediate portion connecting said rearward and forward portions elevated at a second angle greater than said first angle, said travel path being defined along said at least two spaced-apart members in the channel from said inclined rearward portion to said forward portion, said travel path being unobstructed between said rearward and forward portions so that the merchandise unit when placed on the rearward portion or the intermediate portion of said support will descend by gravity to the forward portion of said support for access to the unit in a selected presentation position.

2. The shelf according to claim 1 further comprising:

(a) a plurality of adjacently-spaced walls including first and second outer walls and at least one inner wall, each of said walls having respective lower portions, said plurality of walls defining at least two channels between adjacent ones of said plurality of walls;

(b) a plurality of supports, each of said supports disposed in a respective one of said at least two channels and connecting lower portions of adjacent ones of said plurality of walls; and (c) a connector connected to the lower portions of said first and second outer walls.

3. The shelf according to claim 1 wherein said second angle is between 35° and 45°.

4. The shelf according to claim 1 wherein said first angle is approximately 21°, said second angle is approximately 41°, and said substantially horizontal forward portion is elevated at an angle of approximately 2°.

5. A display device for at least: one modular merchandise unit having a substantially flat base, the display device comprising:

(a) a housing comprising at least one open face; and (b) at least one gravity-feed shelf supported in said housing comprising two spaced-apart adjacent walls defining a channel between said walls and at least one support comprising at least two spaced-apart members disposed in said channel for the base of the merchandise unit to ride on along a travel path in the channel;

wherein the support has an inclined rearward portion elevated at a first angle between 10° and 25°, a substantially horizontal forward portion, and an inclined intermediate portion connecting said rearward and forward portions elevated at a second angle greater than said first angle, said travel path being defined along said at least two spaced-apart members in the channel from said inclined rearward portion to said forward portion, said travel path being unobstructed between said rearward and forward portions so that the merchandise unit when placed on the rearward portion or the intermediate portion of said support will descend by gravity to the forward portion of said support for access to the unit in a selected presentation position.

6. The display device according to claim 5 wherein said at least one shelf comprises:

(a) a plurality of adjacently-spaced walls including first and second outer walls and at least one inner wall, each of said walls having respective lower portions, said plurality of walls defining at least two channels between adjacent ones of said plurality of walls;

(b) a plurality of supports, each of said supports disposed in a respective one of said at least two channels and connecting lower portions of adjacent ones of said plurality of walls; and (c) a connector connected to the lower portions of said first and second outer walls.

7. The display device according to claim 5 wherein said second angle is between 35° and 45°.

8. The display device according to claim 5 wherein said first angle is approximately 21°, said second angle is approximately 41°, and said substantially horizontal forward portion is elevated at an angle of approximately 2°.

* * * * *